US005378215A

United States Patent [19]

Harkins

[11] Patent Number: 5,378,215

[45] Date of Patent: Jan. 3, 1995

[54] REHABILITATION APPARATUS FOR AMBULATORY PATIENTS

[76] Inventor: Robert L. Harkins, 7112 S. Indiana, Oklahoma City, Okla. 73159

[21] Appl. No.: 63,273

[22] Filed: May 14, 1993

[51] Int. Cl.[6] ..... A61H 3/00

[52] U.S. Cl. ..... 482/67; 482/68; 135/67; 297/5

[58] Field of Search ..... 482/41, 51, 66–68; 434/255; 297/5, 192; 280/47.38, 87.05, 87.051, 642, 650; 135/67

[56] References Cited

U.S. PATENT DOCUMENTS

| | | | |
|---|---|---|---|
| D. 112,691 | 12/1938 | Comper | 297/5 |
| 2,210,269 | 8/1940 | Taylor | 482/51 |
| 2,745,465 | 5/1956 | Hogan | 482/67 |
| 2,759,525 | 8/1956 | Ries | 482/67 |
| 2,833,332 | 5/1958 | Nabors | 482/67 |
| 3,256,035 | 6/1966 | Garringer | 482/67 |
| 4,026,568 | 5/1977 | Hallam | 280/650 |
| 4,187,869 | 2/1980 | Marchetti . | |
| 4,212,493 | 7/1980 | Ledesky | 482/66 |
| 4,226,413 | 10/1980 | Daugherty | 482/67 |
| 4,251,105 | 2/1981 | Barker . | |
| 4,277,100 | 7/1981 | Beougher . | |
| 4,861,051 | 9/1989 | Napper . | |
| 4,907,794 | 3/1990 | Rose | 482/68 |
| 5,106,152 | 4/1992 | Ward, Sr. et al. | 297/192 |
| 5,277,438 | 1/1994 | Chuang | 482/68 |

FOREIGN PATENT DOCUMENTS

| | | | |
|---|---|---|---|
| 579543 | 8/1946 | United Kingdom | 482/67 |
| 806651 | 12/1958 | United Kingdom | 482/67 |

*Primary Examiner*—Richard J. Apley
*Assistant Examiner*—Jeanne M. Mollo
*Attorney, Agent, or Firm*—Robert K. Rhea

[57] ABSTRACT

An ambulatory apparatus for rehabilitating individuals is formed by a rigid foldable tubular frame characterized by an open framework formed by a plurality of horizontal side rails defining forward and rearward ends of the frame. Fixed axle rear wheels and a forward caster wheel support the frame for mobile movement. A foldable seat and back rest at the rearward end of the frame supports the user when seated thereon. The uppermost side rails support the user in a walker fashion and normally stored crutch members supported by the side rails are available for a user needing crutches. Manually operated brake pads are movable toward and away from the rear wheels for anchoring the apparatus or controlling its rate of descent on a downgrade.

1 Claim, 2 Drawing Sheets

REHABILITATION APPARATUS FOR AMBULATORY PATIENTS

BACKGROUND OF THE INVENTION

The present invention relates to mobility aides and more particularly to an apparatus for assisting ambulatory patients in moving about.

1. Field of the invention

Walkers and wheel chairs are generally used by the elderly or disabled persons. A walker adds stability and a feeling of assurance to persons unstable when walking and wheelchairs add mobility to the individual capable of manipulating the wheels of the wheel chair.

Neither a walker nor a wheelchair is particularly conducive toward rehabilitating an individual who has suffered a major injury. The walker generally does not include a place or seat for the user to be seated when undergoing rehabilitation and becomes tired and the wheelchair is not conducive toward the individual utilizing or exercising his legs as when walking.

This invention overcomes both of these disadvantages in providing a mobile unit which surrounds the user during rehabilitating exercises providing both a seat, rails and crutches for stability when walking.

2. Description of the prior art

The most pertinent patent is believed to be U.S. Pat. No. 4,277,100, issued Jul. 7, 1981, to Beougher for AMBULATORY APPARATUS. This patent discloses a walker-type up-right open frame of general U-shape in top view featuring a rearward seat and upward and lower rails with fixed axle forward wheels and caster-type rearward wheels. A spring urged brake normally engages the forward wheels, which may be released for free wheel movement of the device.

U.S. Pat. No. 4,187,869, issued Feb. 12, 1980, to Marchetti for ORTHOPEDIC DEVICE discloses an upright frame supported by caster wheels and having an adjustable seat thereon features upstanding crutch arms having shoulder supports at their upper ends and handles at their lower ends, thus, providing a combination walker, a seat for resting and crutches for moving about in an ambulatory manner.

This invention is distinctive over the above named patents by providing a mobile frame which surrounds the user and includes a foldable seat having a back rest and is provided with forward utility baskets and a combination eating and working tray.

U.S. Pat. No. 4,251,105, issued Feb. 17, 1981, to Barker for MOBILITY AID and U.S. Pat. No. 4,861,051, issued Aug. 29, 1989, to Napper for REHABILITATION WALKER DEVICE are considered good examples of the further state-of-the-art.

The Barker patent discloses an upright generally U-shaped, in top view, frame having fixed axle forward wheels which are spring mounted in their supports, so that downward pressure on the frame depresses the frame relative to the wheels to engage forward and downwardly projecting stabilizing struts against the surface of the earth for stability when desired. The frame further features arm supports and a fold down seat. The Napper patent discloses a caster wheel supported frame having forward handle bars for guidance and a rearward seat which is vertically adjustable.

SUMMARY OF THE INVENTION

This invention includes an upright open framework characterized by vertically spaced upper and lower rails completely surrounding the position of a user and having fixed axle rearward wheels and a caster-type forward wheel utilizing balloon-type tires for ease of mobility.

The rails are hingedly connected together at their forward ends for movement of the frame sides toward and away from each other by removing rearward stabilizing spacers for occupying a minimum of space when in storage or for transport.

Foldable cushioned seats at the rearward limit of the frame overlie a bedpan-type tray while a back support projects above the uppermost stabilizing spacer and patient operated brakes anchor the device or controls its descent on a downgrade.

Normally stored crutches are removably received by upwardly open frame sockets.

The forward portion of the frame supports two basket-type compartments for miscellaneous equipment and a removable tray transversely overlies the forward part of the frame to serve as an eating tray or working surface.

The principal object of this invention is to provide a rehabilitation apparatus having a low center of gravity which may be used as a walker or propelled with one or both feet having sufficiently large wheels for moving over obstacles, such as curbs, with ease and includes crutches for use in supporting a patient while moving the apparatus and having hand brakes for anchoring or retarding movement while negotiating a downgrade and includes baskets for carrying equipment such as groceries and a table tray for eating or paperwork which will enable an individual to rehabilitate themselves and provide individual freedom and independence.

DESCRIPTION OF THE PREFERRED EMBODIMENTS

Figure 1:
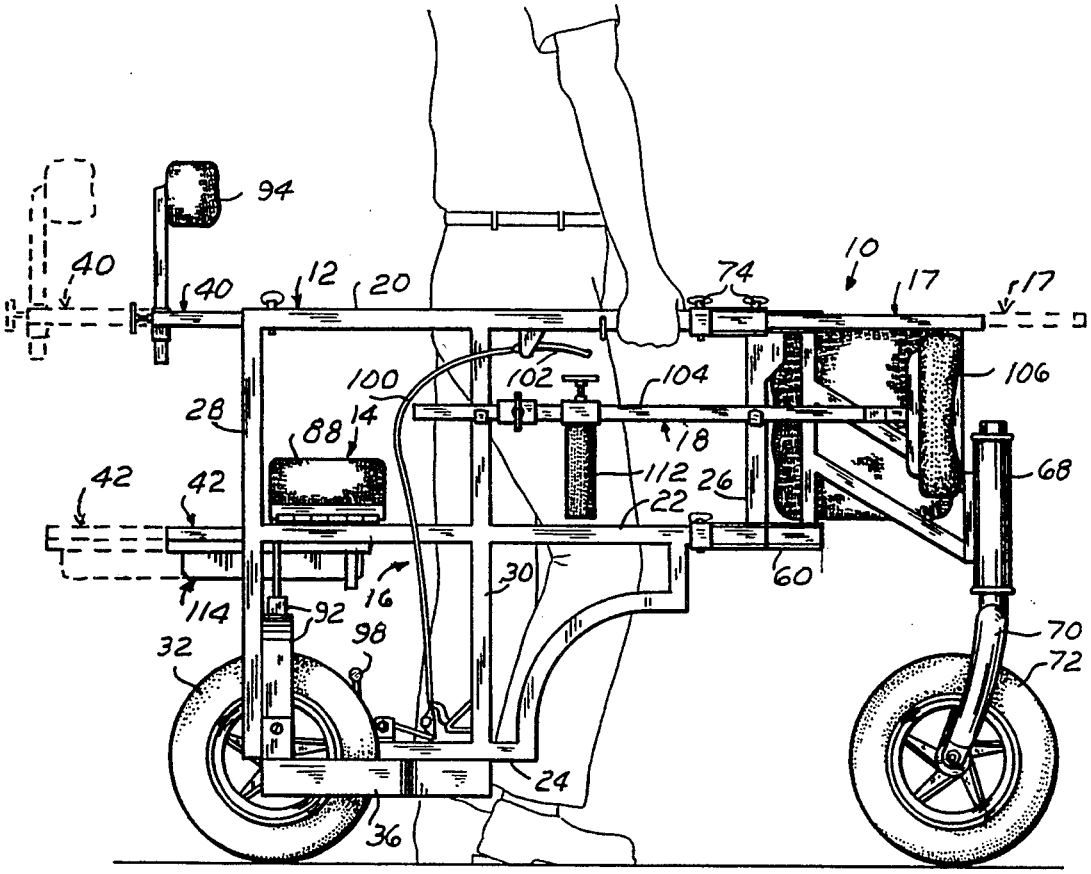
FIG. 1 is a side elevational view of the apparatus in operative position and illustrating by dash lines, telescoping movement of the rearward upper and lower cross members and forward basket rail.

Like characters of reference designate like parts in those figures of the drawings in which they occur.

In the drawings:

The reference numeral 10 indicates the apparatus as a whole comprising a frame 12 having a seat means 14, a brake means 16, compartment means 17 and crutch means 18.

The frame 12 is generally rectangular in overall configuration preferably formed from rigid tubing material and is characterized by parallel laterally spaced upright side member formed by top or upper rails 20 and 21 and intermediate rails 22 and 23 spaced downwardly in parallel relation with respect to the top rails and bottom rails 24 and 25 spaced downwardly with respect to the intermediate rails.

Vertical forward standards 26 and 27 respectively extend between and are rigidly connected with the top and intermediate rail forward end portions.

Rearward standards 28 and 29 rigidly connect the rearward end portions of the upper, intermediate and bottom rails.

Intermediate standards 30 and 31 similarly extend vertically and interconnect the upper, intermediate and bottom rails.

A pair of rearward wheels 32 and 33 having their respective hubs 34 and 35 journalled on transversely aligned axles, not shown, rigidly connected, respectively, at one end to the outer surface of the depending end portion of the respective rearward standards 28 and 29 with the other end of these axles secured to wheel guards 36 and 37, respectively, in turn secured to the respective lower rail 24 and 25.

The rearward end portions of the upper rails 20 and 21 and intermediate rails 22 and 23 are rigidly joined by upper and lower U-shaped horizontal frame cross members 40 and 42, respectively, each having pairs of legs 44 and 46, respectively, which respectively enter the rearward ends of the upper rails 20 and 21 and intermediate rails 22 and 23. Fasteners 48 secure the upper U-shaped member 40 to the upper rails for use of the member 40 as a handle in moving the apparatus.

Upper lateral plate hinges 50 and 51 hingedly connect the forward end portion of the upper rails 20 and 21, respectively; to one end, respectively, of a pair of upper front frame braces 52 and 53. Upper center hinge plates 54 hingedly join the abutted ends of the upper front cross members 52 and 53.

Similarly, lower lateral hinge plates 56 and 57 hingedly join a forward end portion of the intermediate rails 22 and 23 to a lower pair of front cross members 58 and 59. Lower center frame hinge plates 60 hingedly join the abutted ends of the lower frame cross members 58 and 59.

A front wheel strut 62 extends vertically between and is rigidly secured at its respective ends to the confronting plates of the upper and lower center hinges 54 and 60. Vertically spaced parallel forward and downwardly inclined front wheel brace members 64 are rigidly connected at one end to the front wheel strut 62 and rigidly connected at their other ends to a sleeve 68 journalling the shaft of a bicycle-type front wheel fork 70 on a vertical axis, in turn, journalling a front wheel 72 in caster fashion.

Hinge lock pins 74 join the plate 50, 51, 54 and 60 hinges to selected frame members to permit a folding movement of the frame 12 as hereinafter explained.

A forward U-shaped horizontal basket rail 76 having parallel legs 78 and 79 supported at their rearward end portions by the front standards 26 and 27, respectively, is further provided with a center rail 80 connected at one end with the bight portion of the basket rail and removably supported at its other end portion by the top center hinge plates 54.

A third leg 82 of the basket rail is connected with its bight portion in vertical depending relation and has its depending end bifurcated for straddling in supporting relation the uppermost wheel rail 64, thus, forming a pair of basket compartments respectively receiving a fabric basket 84 removably connected at their upper open end edges with a series of hooks 86 on the inner edge surfaces of the basket rail 76 and its leg 80.

The seat means 14 comprises a pair of horizontal padded seat panels 88 and 89 hingedly connected in transversely aligned relation by hinges to the rearward end portion of the respective intermediate side rails 22 and 23 adjacent the rearward standards 28 and 29, respectively, and substantially above the fixed rear wheel axis to lower the frame center of gravity. The inner end portion of the respective padded seat 88 and 89 is supported by a hingedly connected angularly disposed rod 90 and 91, respectively extending downward and outward for vertical sliding engagement with slotted guide tubes 92 and 93 respectively secured vertically to the forward depending end portion of the rearward standards 28 and 29, thus, permitting the seats 88 and 89 to be vertically pivoted about the horizontal axis of the respective hinge for the reasons presently explained. The seat means 14 further includes a back support pad 94 centrally supported by a vertical strut adjustably secured to the bight portion of the top U-shaped member 40.

The brake means 16 comprises a pair of brake pads 98, only one being shown, disposed adjacent the periphery of the rear wheels 32 and 33 which are actuated by a pair of Bowden cables 100 and 101 controlled by operator actuated handles 102 and 103. Brake handle locks 103' on the respective top rail maintains the wheels brake locked when desired.

The crutch means 18 comprises a pair of tubular shafts 104 and 105 having a shoulder pad 106, only one being shown, at one end portion, normally horizontally supported by brackets 108 attached to the forward and intermediate standards of the frame sides. When in use the crutch shafts 104 and 105 are inserted at their ends opposite the shoulder pads into the upper open end of the intermediate standards 30 and 31. The shoulder pads are maintained in a selected elevated position by sleeves 110 and 111 adjustably secured to the respective crutch shaft. Handles 112 and 113 slidably adjustable vertically on the crutch shaft enable the operator to use the crutches and move the apparatus 10 in a mobile manner while walking with the crutches.

The apparatus 10 further includes a rectangular upwardly open container 114 having outwardly projecting parallel flanges which are slidably received in grooves formed by a pair of channel members 116 secured at one end portion in parallel forwardly projecting a relation to the bight portion of the lower U-shaped member 42 to normally dispose the tray below the position of the padded seat members 88 and 89.

Additionally, the apparatus 10 includes an eating or serving tray 116 generally rectangular in overall configuration which extends transversely of the frame 12 adjacent the forward limit of the upper rails 20 and 21 and is supported at its forward limit by the upper center hinge member 54 and its components.

Operation

Figure 3:
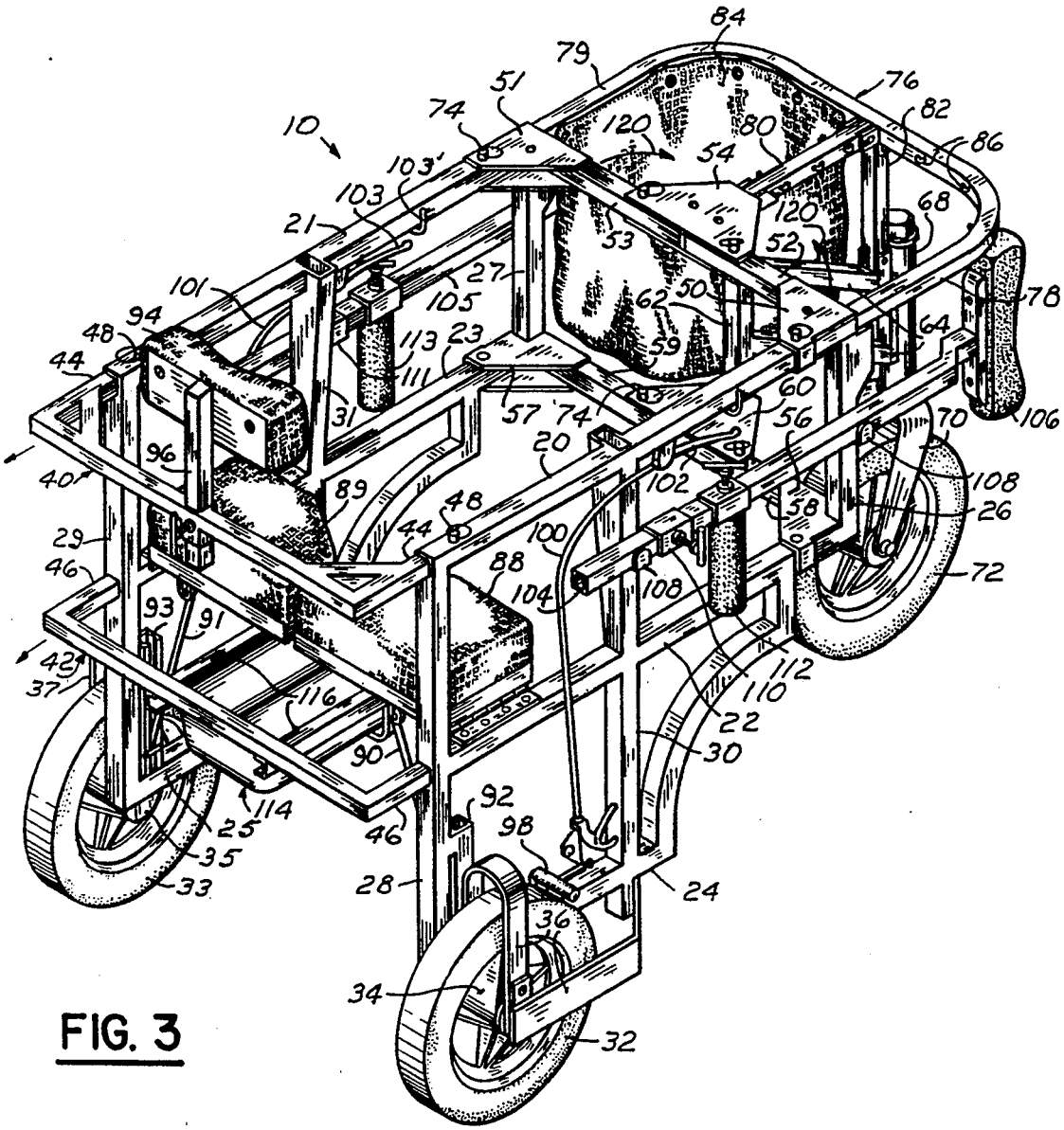
FIG. 3 is a perspective view of the apparatus, per se; and, FIG. 4 is a fragmentary perspective view illustrating the relative position of the eating tray or platform.
Figure 4:
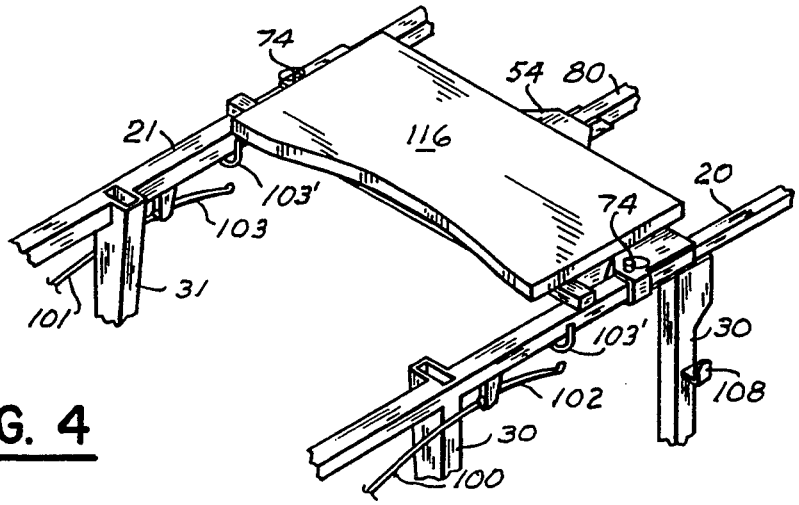

In operation, a user enters the frame 12 by removing the rearward U-shaped members 40 and 42 and pivoting the padded seats upwardly toward the respective top rail 20 and 21. After entering the frame, the U-shaped members 40 and 42 are replaced to the position illustrated by FIGS. 1 and 3 and the seats pivoted downwardly if used.

Figure 2:
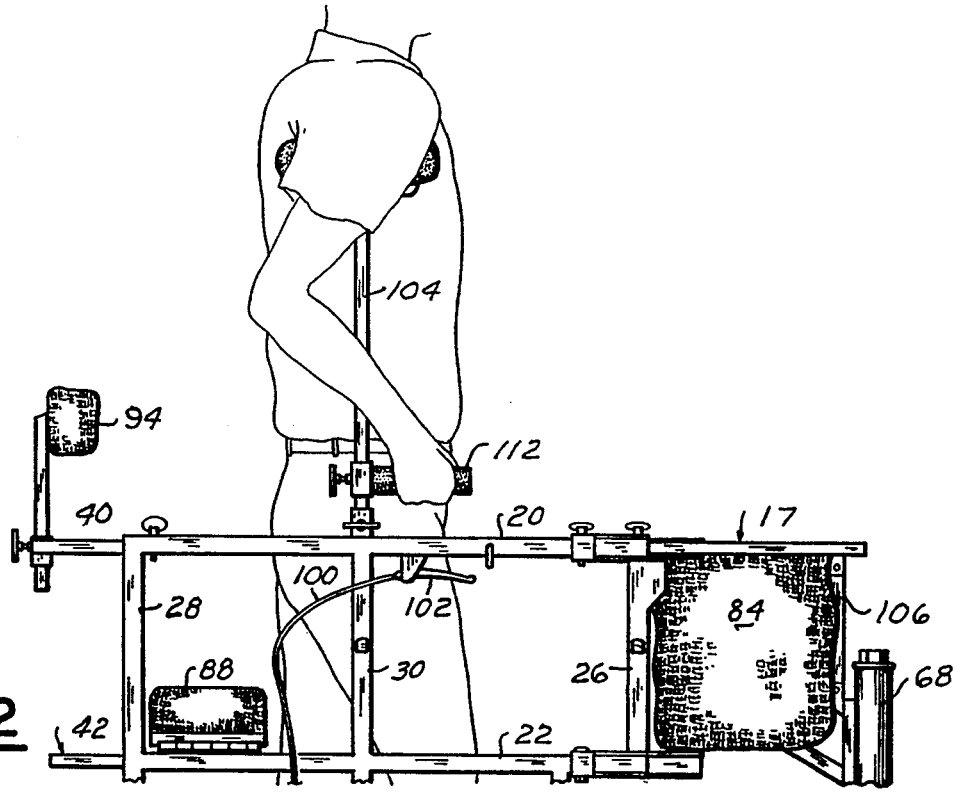
FIG. 2 is a view similar to FIG. 1 illustrating the position of the crutches when in use.

Thereafter, the user while seated on the seat may be moved by an attendant grasping the bight portion of the member 40 or, if capable of foot movement, may propel himself by the feet contacting the surface on which the device rests, being guided also by foot movement. Alternatively, if the patient needs to exercise in a walking position he grasps the top rails 20 and 21, as illustrated by FIG. 1, for movement of the apparatus. If one of his legs is incapacitated, the crutch means 18 is positioned, as shown by FIG. 2 and as described hereinabove, for moving about with the use of the crutches.

A further feature of the apparatus 10 is that it may be stored in a relatively small area by collapsing the frame which is accomplished by removing the U-shaped members 40 and 42, the basket top rail 76 and the hinge plate fastening pins 74 so that the pairs of top front members 52, 53, 58 and 59 may pivot about their hinge connection with the plate hinge members 54 and 60 in the directions of the arrows 120, thus, permitting the side rail members to move toward each other as individual units and occupy a minimum of space transversely.

Obviously the invention is susceptible to changes or alterations without defeating its practicability. Therefore, I do not wish to be confined to the preferred embodiment shown in the drawings and described herein.

I claim:

1. A mobile rehabilitation apparatus, comprising:

frame means including a pair of vertically spaced upper and lower tubular side rails which are interconnected by standards at each end of the rails, each said pair of side rails is laterally spaced and interconnected at their respective forward ends by pairs of upper and lower front cross members, each pair of said pairs of front cross members being pivotally connected together in longitudinal alignment during normal usage by a center hinge, said side rails being separably interconnected at their respective rearward ends by upper and lower U-shaped cross members having parallel legs removably received telescopically by the respective upper and lower frame side rail, said standards are connected in a manner to form a pair of forward standards and a pair of rearward standards, and said frame means forms a vertically open frame for surrounding a user;

basket means including a horizontal forward u-shaped basket rail having parallel legs removably supported telescopically by the forward end portions of said upper side rails for precluding pivoting movement of said upper and lower pairs of front cross members during normal usage;

wheel means including a pair of rear wheels mounted on a fixed axis extending transversely of said frame means adjacent the depending end portions of said rearward standards and a forward caster wheel means secured to said forward frame cross members center hinges; and, seat means including a pair of cushion seats hingedly connected respectively with said lower side rails and normally extending transversely of said frame means adjacent the lower rearward frame cross member above the rear wheels fixed axis for forming a low center of gravity for said frame means when occupied by a user, whereby the frame means may be laterally collapsed without extending its overall longitudinal length by removing the basket means rail and the rearward U-shaped cross members and manually juxtaposing the upper and lower side rails by the center hinge connected end portion of the respective pair of upper and lower front cross members center hinges pivoting rearwardly.

* * * * *